United States Patent [19]

Strahs

[11] 4,216,562

[45] Aug. 12, 1980

[54] SPONGE MOP REFILL

[75] Inventor: Martin P. Strahs, Lawrenceville, N.J.

[73] Assignee: Quickie Manufacturing Corporation, Cinnaminson, N.J.

[21] Appl. No.: 956,432

[22] Filed: Oct. 31, 1978

[51] Int. Cl.[3] ..... A47L 13/257

[52] U.S. Cl. ..... 15/119 A

[58] Field of Search ..... 15/116 A, 119 A, 244 R, 15/244 A, 244 B; 401/207

[56] References Cited

U.S. PATENT DOCUMENTS

| | | | |
|---|---|---|---|
| 2,685,098 | 8/1954 | Palma et al. | 15/244 A X |
| 2,877,478 | 3/1959 | Kohlwey et al. | 15/119 A |
| 3,050,761 | 8/1962 | Morgan | 15/119 A |
| 3,147,502 | 9/1964 | Richards | 15/119 A X |
| 3,287,756 | 11/1966 | Gesell | 15/244 R X |

FOREIGN PATENT DOCUMENTS

| | | | |
|---|---|---|---|
| Ad.73812 | | | |
| 1191353 | 9/1960 | France | 15/119 A |
| 741136 | 11/1955 | United Kingdom | 15/244 R |
| 932579 | 7/1963 | United Kingdom | 15/119 A |
| 967566 | 8/1964 | United Kingdom | 15/116 A |
| 1181230 | 2/1970 | United Kingdom | 15/244 R |

*Primary Examiner*—Philip R. Coe

*Attorney, Agent, or Firm*—Weiser, Stapler & Spivak

[57] ABSTRACT

A sponge mop refill comprises a cellular foam body to which is affixed a thin, stiff, hard, planar backing strip. The backing strip is centrally cut out to provide needed flexibility as the refill is medially bent during the water extracting procedure. A pair of spaced, plastic, accordion rivets have their heads interposed between a surface of the foam body and a surface of the backing strip and are installed with the rivet shank extending outwardly through the backing member to facilitate easy application to and removal from a sponge mop.

6 Claims, 4 Drawing Figures

SPONGE MOP REFILL

BACKGROUND OF THE INVENTION

This invention relates generally to mop refills, and more particularly, is directed to a refill assembly for use with sponge mops.

Sponge mop refills of the type generally described in this invention have previously been employed with sponge mops as shown in U.S. Pat. Nos. 2,643,407 and 2,834,035. The prior art mops described in the above cited patents disclose generally a sponge that was removably associated with the mechanical portions of the mop assembly. The sponges of the prior art mops were adapted to be folded medially during the water extraction process and were provided with fastening devices to easily permit sponge replacement due to wear, deterioration or other reason. The present invention is directed to improving the sponge replacement means and to enhancing the water pick-up capabilities of the device.

The prior art refill sponges of the general type described in this application usually incorporate a backing member and a threaded type of fastening means for affixing the sponge to the mop construction. These fastening means required either screws or thumb nuts to affix the sponge to the metallic portions of the mop assembly. After extended periods of use, usually in a water environment, the threaded members have proved difficult to operate and sponge replacement sometimes presented a considerable chore. Further, the softness of the prior art sponge backing member, if used at all, did not aid in the operational functions of the sponge mop after assembly.

SUMMARY OF THE INVENTION

The present invention relates generally to sponge mop refills, and more particularly is directed to a sponge refill assembly featuring improved mop attachment means and improved water extraction construction.

The sponge mop refill of the present invention comprises generally a rectangularly shaped replacement sponge suitable for use with an existing sponge mop, such as the sponge mop manufactured and sold by Quickie Manufacturing Corporation, Cinnaminson, N.J., under the trademark "AUTOMATIC".

The sponge refill assembly comprises a sponge body approximately one inch to one and one-half inches in thickness fabricated of cellular material which may be double cell, non-reticulated, polyurethane foam plastic. The improvement of the present invention is directed to the application of a relatively thin, stiff, hard, plastic backing member which is affixed to the top surface of the cellular foam sponge body. Improved mop fastening means in the form of plastic accordion or panel fastening type rivets are provided. The rivets have their heads interposed between the sponge body and the backing member and are oriented so that the respective rivet shanks extend upwardly through the backing member to engage cooperating holes which are conventionally provided in the metallic squeeze plates of the sponge mop construction. The plastic rivets facilitate easy attachment to and removal from the sponge mop for sponge refill replacement purposes.

It is therefore an object of the present invention to provide an improved sponge mop refill of the type set forth.

It is another object of the present invention to provide a novel sponge mop refill comprising a cellular foam plastic body and a hard, thin, relatively stiff plastic backing member adhered thereto.

It is another object of the present invention to provide a novel sponge mop refill comprising improved sponge mop attachment means.

It is another object of the present invention to provide a novel sponge mop refill comprising a cellular foam plastic body, a relatively thin, stiff, hard, plastic backing member secured thereto and a plastic rivet having its head interposed between the backing member and the foam plastic body to facilitate easy attachment to and removal from the metallic squeeze plates of the sponge mop.

It is another object of the present invention to provide a novel sponge mop refill that is inexpensive in manufacture, simple in design and trouble free when in use.

Other objects and a fuller understanding of the invention will be had by referring to the following description and claims of a preferred embodiment thereof, taken in conjunction with the accompanying drawings, wherein like reference characters are similarly referred to throughout and wherein:

DESCRIPTION OF THE PREFERRED EMBODIMENT OF THE INVENTION

Figure 1:
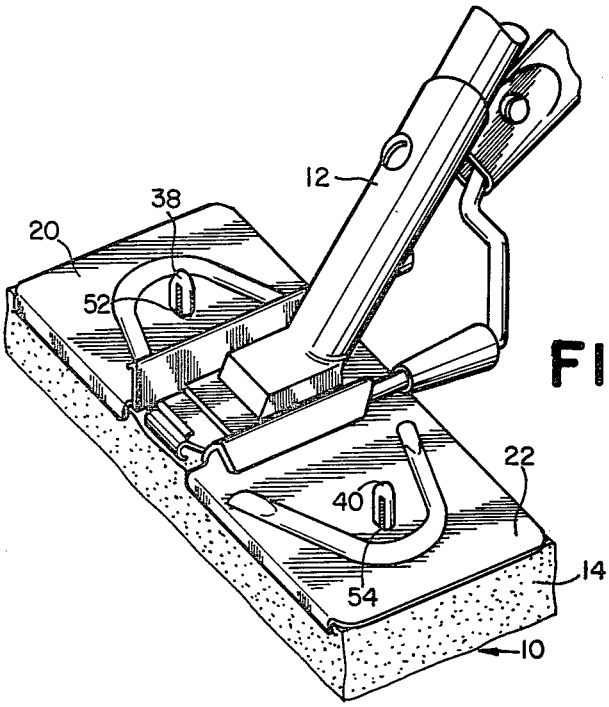
FIG. 1 is a perspective view of the sponge mop refill applied to a sponge mop.

Although specific terms are used in the following description for the sake of clarity, these terms are intended to refer only to the particular structure of the invention selected for illustration in the drawings and are not intended to define or limit the scope of the invention.

Referring now to the drawings, there is shown in FIG. 1 a sponge mop refill assembly 10 applied to a sponge mop 12 in position for conventional use in mopping floors and other surfaces. The sponge mop 12 itself has been fully described in U.S. Pat. Nos. 2,643,407 and 2,834,035 as above set forth and forms no part of the present invention. Accordingly, the details of the sponge mop 12 need not be set forth at length in this application. The sponge refill body 14 is fabricated from a double cell, non-reticulated foam plastic of a type suitable to absorb large quantities of water in comparison to its weight and size. One such material found suitable for this purpose is manufactured by the Nauer Company of Zurich, Switzerland, and sold by Quickie Manufacturing Corporation, Cinnaminson, N.J., under the trademark "CELLULENE".

Figure 2:
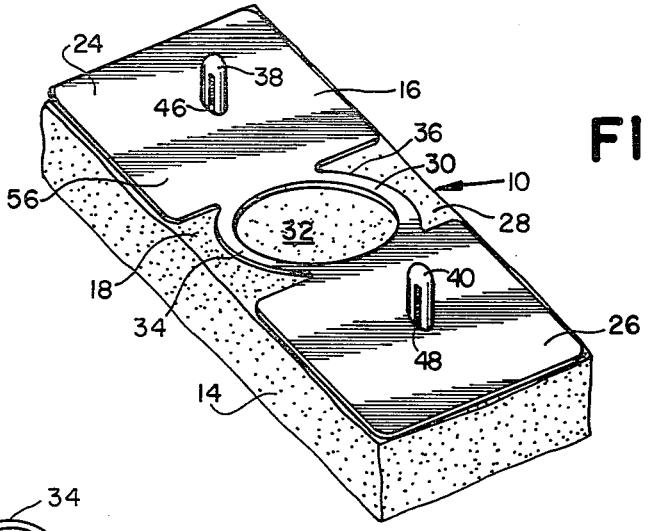
FIG. 2 is a perspective view of the sponge mop refill of the present invention.
Figure 4:
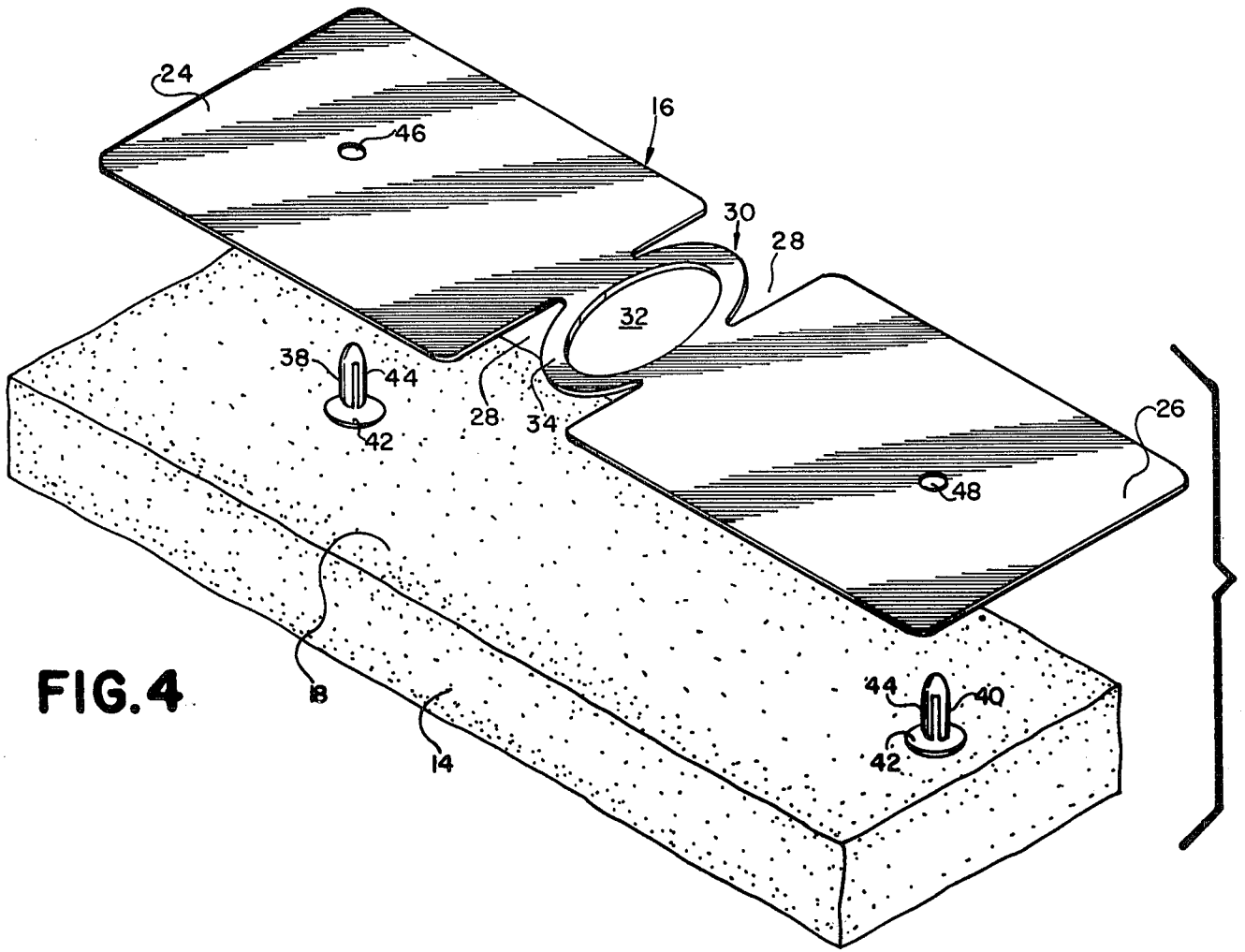
FIG. 4 is an enlarged, exploded, perspective view of the sponge mop refill.

As best seen in FIGS. 2 and 4, a thin, relatively, stiff, hard, plastic backing member 16 is affixed to the top surface 18 of the cellular foam refill body 14. The stiffness of the backing member or strip 16 produces better water extraction from the cellular foam body 14 upon operation of the sponge mop 12 by assuring the application of uniform, even, squeezing forces upon the foam material. When the hinged, metallic squeeze plates 20, 22, of the sponge mop 12 are functioned in the usual manner, the squeezing forces are applied to the backing strip which then acts to uniformly apply the forces throughout the foam body 14 to produce even water extraction as the squeezing action bends the sponge body double. The enhancement of the water extraction capability produced by the stiffness and hardness of the backing strip 16 results in more efficient water pick up by the sponge refill assembly and therefore improves the operation of the device. Simply stated, because the refill assembly construction results in squeezing more water out of the sponge body 14, the cellular construction of the body 14 can then pick up increased quantities of water from a floor or other surface when in use.

Figure 3:
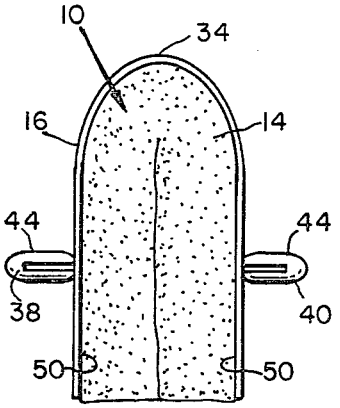
FIG. 3 is an end elevational view showing the sponge mop refill in the water extracting position.

The backing strip 16 is fabricated preferably between 1/32" and 1/16" in thickness and is manufactured from an acrylic pvc plastic such as the plastic strip material manufactured and sold by Rohm and Haas Company, Philadelphia, Pa., under the trademark "KYDEX". If the backing strip 16 is less than 1/32" in thickness, then it will not possess sufficient strength to function without distortion when the sponge mop is operated. Greater thicknesses than 1/16 inch will result in increased cost and material waste. As illustrated, the backing strip 16 is fabricated to a planar configuration having a pair of spaced press feet 24, 26 which are outwardly spaced from medial cut out area 28. The medial cut out area 28 is provided to lend necessary flexibility in the central area of the backing strip 16 to permit bending about the central area during the water extraction process. The press feet 24, 26 are spaced apart by the thin, central web 30 which spans the cut out area 28 and is thin enough to facilitate easy bending of the feet 24, 26 to squeeze the assembly body 14 together for water extraction purposes. See FIG. 3.

In the preferred embodiment, the central web 30 comprises a pair of spaced, thin, arcuate sections 34, 36 which interconnect the press feet 24, 26 in a manner not to interfere with the bending operation during water extraction. The central area 32 defined between the arcuate sections 34, 36 is preferably cut out to form an open area to facilitate uniform bending about the central axis of the body 14.

In order to connect and disconnect the sponge refill assembly 10 from the sponge mop 12, connecting means preferably in the form of plastic accordion rivets 38, 40 are provided. The accordion rivets are of the type comprising generally a flat head 42 with an integral compressible shank 44 extending outwardly therefrom. Preferably, the rivets 38, 40 are of the type manufactured and sold by TRW Carr Division, Cambridge, Mass., and designated accordion type, plastic rivets. Each press foot 24, 26 is provided with a generally centrally located opening 46, 48 through which a respective rivet shank 44 upwardly projects. It will be noted that the rivet heads 42 are interposed between the upper surface 18 of the sponge body 14 and the lower surface 50 of the backing strip 16.

In the preferred embodiment, the backing strip 16 is permanently affixed to the top surface 18 of the body 14 by utilizing a suitable adhesive such a fabrication serves to permanently affix the rivet heads 42 between the sponge body 14 and the backing member 16. One adhesive suitable for the purpose is the solvent based, high solids contact type adhesive sold by A. Z. Bogert Co., Inc., Baltimore Md., Adhesive No. 155. Thus, when the bottom surface 50 of the backing strip 16 is secured to the top surface 18 of the cellular foam body 14 by utilizing a suitable adhesive, the accordion rivets 38, 40 are permanently fixed in place with the respective shank portions 44 thereof projecting upwardly as illustrated in FIG. 2.

In order to use the sponge refill assembly of the present invention, the sponge refill assembly 10 is applied to the sponge mop 12 by inserting the rivet shank portions 44 upwardly through the existing openings 52, 54 which are normally provided in the mop squeeze plates 20, 22 for removable attachment of a sponge refill assembly. The refill assembly 10 cah be rather easily applied to the sponge mop 12 by simply aligning the tips of the rivet shanks 44 with the squeeze plate openings 52, 54 and then applying upwardly directed forces of sufficient magnitude to allow the rivet shanks to compress inwardly sufficiently to pass through the openings 52, 54 and then to automatically expand in the manner designed to thereby retain the assembly 10 to the sponge mop 12. To remove the sponge refill assembly 10 from association with the sponge mop 12 for replacement or other purpose, the operator need simply apply a relatively broad instrument (not shown), for example a screw driver, between the bottoms of the squeeze plates 20, 22 and the top surface 56 of the backing strip 16. Then by twisting sufficiently to build up separation forces of sufficient magnitude to inwardly compress the rivet shanks 44, the sponge refill assembly 10 can be easily removed from association with the sponge mop 12.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a sponge refill assembly suitable for use with a sponge mop, the combination of a body of cellulosic sponge material suitable to retain a quantity of water therewithin, said body comprising an exterior surface;

a unitary backing strip applied to the body at the said exterior surface, said backing strip being fabricated of relatively thin, stiff, hard material, said backing strip being securely affixed to the body surface, the backing strip comprising a pair of spaced press feet, the press feet being separated by a weakened, medial cut out area whereby the refill assembly can be medially folded by bending the backing strip at the weakened area, the medial cut out area comprising an integral, thin web interconnecting the press feet, the said web being adapted to be bent when the refill assembly is folded, and a cut out open area intermediate the press feet and adjacent to the web, the open area being greater in area than the area of the thin web, and fastening means retained by the backing strip, said fastening means comprising a shank portion extending from the backing strip in a direction away from the body, said shank portion including means adaptable to releasably secure the sponge refill assembly to to a sponge mop, whereby the refill assembly can be medially folded by bending the backing strip thin web to squeeze the sponge material for water extraction purposes.

2. The refill assembly of claim 1 wherein the thin web comprises a pair of spaced, thin sections interconnecting the press feet and wherein a part of the cut out area is positioned in between the said thin sections.

3. The refill assembly according to claim 2 wherein at least one of the pair of thin sections is curved.

4. The refill assembly of claim 2 wherein a part of the cut out area is positioned on each side of each of the said thin sections.

5. In a sponge refill assembly suitable for use with a sponge mop, the combination of a body of cellulosic sponge material suitable to retain a quantity of water therewithin, said body comprising an exterior surface;

a backing strip applied to the body at the said exterior surface, said backing strip being fabricated of relatively thin, stiff, hard material, said backing strip being securely affixed to the body surface, said backing strip comprising at least a pair of spaced press feet, the said press feet being separated by a weakened area whereby the refill assembly can be medially folded by bending the backinhg strip at the weakened area, said press feet being interconnected by a thin web, the said web being adapted to be bent when the refill assembly is folded, the interconnecting web comprising a pair of thin, arcuate sections, the said arcuate sections and the said press feet defining a circular center opening, the arcuate sections and the center opening being adapted to facilitate bending of the backing strip when the refill assembly is folded for water extraction; and fastening means retained by the backing strip, said fastening means comprising a shank portion extending from the backing strip in a direction away from the body, said shank portion including means adaptable to releasably secure the sponge refill assembly to a sponge mop.

6. The sponge refill assembly of claim 1 wherein the backing strip is fabricated from an acrylic pvc, stiff, hard plastic.

* * * * *